US010164364B2

(12) United States Patent
Asanuma et al.

(10) Patent No.: US 10,164,364 B2
(45) Date of Patent: Dec. 25, 2018

(54) CONNECTOR

(71) Applicant: Molex, LLC, Lisle, IL (US)

(72) Inventors: Naoto Asanuma, Yamato (JP); Yasuaki Kobayashi, Yamato (JP); Akihiro Ishii, Yamato (JP); Akihiko Okajima, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/925,863

(22) Filed: Mar. 20, 2018

(65) Prior Publication Data

US 2018/0277974 A1 Sep. 27, 2018

(30) Foreign Application Priority Data

Mar. 21, 2017 (JP) ..... 2017-054382

(51) Int. Cl.

| | |
|---|---|
| ***H01R 13/66*** | (2006.01) |
| ***H01R 12/77*** | (2011.01) |
| ***H01R 13/639*** | (2006.01) |
| ***H01R 12/79*** | (2011.01) |
| *H01R 12/87* | (2011.01) |

(52) U.S. Cl.
CPC ..... *H01R 12/774* (2013.01); *H01R 12/79* (2013.01); *H01R 13/639* (2013.01); *H01R 12/87* (2013.01)

(58) Field of Classification Search
CPC . H01R 13/6658; H01R 13/22; H01R 23/7073
USPC ..... 439/620.01, 289, 79
See application file for complete search history.

(56) References Cited

U.S. PATENT DOCUMENTS

| | | | | |
|---|---|---|---|---|
| 8,317,533 | B2 * | 11/2012 | Ishimaru | H01R 12/79 439/345 |
| 8,678,844 | B2 * | 3/2014 | Yoshisuji | H01R 12/592 439/260 |
| 8,968,020 | B2 | 3/2015 | Nishiyama | |
| 9,455,531 | B2 * | 9/2016 | Qian | H01R 12/772 |
| 9,490,559 | B2 | 11/2016 | Takane | |
| 2006/0089045 | A1 * | 4/2006 | Miura | H01R 12/88 439/495 |

FOREIGN PATENT DOCUMENTS

| | | | |
|---|---|---|---|
| JP | 2012-199187 | A | 10/2012 |
| JP | 2013-008544 | A | 1/2013 |
| JP | 2016-052823 | A | 4/2016 |

(Continued)

*Primary Examiner* — Phuong Chi T Nguyen
(74) *Attorney, Agent, or Firm* — James A. O'Malley

(57) ABSTRACT

A connector may have a housing having a housing part housing a flat cable, and a mounting member mounted to the housing for locking the flat cable. The mounting member may have a mounting part mounted to at least one of the housing and a circuit board, an elastic part extending in a width direction of the flat cable, an extending part extending in the width direction of the flat cable, and an engaging part engaging with an engaged part formed on the flat cable. The mounting part may be connected to an end part in the width direction of the elastic part. An intermediate region of the extending part may be connected to an intermediate region in the width direction of the elastic part. The engaging part may be connected to an end part in the width direction of the extending part. The elastic part may be elastically deformable in a thickness direction of the flat cable.

8 Claims, 7 Drawing Sheets

(56) References Cited

FOREIGN PATENT DOCUMENTS

| | | | |
|---|---|---|---|
| JP | 2016-096127 | A | 5/2016 |
| JP | 2016-096128 | A | 5/2016 |
| WO | WO 2008-074306 | A1 | 6/2008 |

* cited by examiner

CONNECTOR

RELATED APPLICATIONS

This application claims priority to Japanese Application No. 2017-054382, filed Mar. 21, 2017, which is incorporated herein by reference in its entirety.

TECHNICAL FIELD

The present disclosure relates to a connector.

BACKGROUND ART

Patent document 1 below discloses a mounting member mounted to a housing of a connector. An engaging part (lock part 19 in patent document 1) is formed on the mounting member. The engaging part engages with a flat cable (flexible printed circuit board 30 in patent document 1) housed in a housing portion (plate-shaped member insertion part 12 in patent document 1) of a housing. Thus, the flat cable can be locked to the connector. Furthermore, an elastic part (mobile arm-shaped part 18 in patent document 1) is formed on the mounting member, and extends in an extending direction (up-down direction in patent document 1) of a terminal inserted into the connector. By moving the elastic member via operation of a user, the engaging part moves along the width direction of the flat cable housed in the connector, and the engagement with the flat cable is released.

Patent Document 1: Japanese Unexamined Patent Application Publication No. 2012-199187

SUMMARY

In the mounting member of patent document 1, the elastic part is formed in a leaf spring shape and extends along the extending direction of the terminal, and the engaging part is formed in the middle of this elastic part. With such a mounting member shape, there is a possibility that the spring length of the elastic part cannot be sufficiently secured and the movement amount of the engaging part accompanying the elastic deformation of the elastic part cannot be sufficiently secured.

An object of the present disclosure is to make it possible to sufficiently secure the spring length of the elastic part formed on the mounting member of the connector.

The connector according to the present disclosure may have a housing having a housing part housing a flat cable, and a mounting member mounted to the housing for locking the flat cable. Here, the mounting member may have a mounting part mounted to at least one of the housing and a circuit board, an elastic part extending in a width direction of the flat cable, an extending part extending in the width direction of the flat cable, and an engaging part engaging with an engaged part formed on the flat cable. The mounting member may be connected to an end part in a width direction of the elastic part. An intermediate region of the extending part may be connected to an intermediate region in a width direction of the elastic part. The engaging part may be connected to an end part in a width direction of the extending part. The elastic part may be made to be elastically deformable in a thickness direction of the flat cable. By doing so, the spring length of the elastic part formed on the mounting member can be sufficiently secured.

Furthermore, in one embodiment of the connector, the mounting member may have a fixing part fixed to the housing or the circuit board, and an elastically deformable elastic region positioned separated from the fixing part. Here, the mounting member may be connected to an end part in the width direction of the elastic part in the elastic region.

Furthermore, in one embodiment of the connector, the fixing part may have an inserting part inserted into the housing that fixes the fixing part to the housing.

Furthermore, in one embodiment of the connector, the fixing part may have a board fixing part fixed to the circuit board.

Furthermore, in one embodiment of the connector, the mounting part may have a first mounting part positioned on one end part of the elastic part, and a second mounting part positioned on another end part of the elastic part.

Furthermore, in one embodiment of the connector, the engaging part may have an arm part extending facing the thickness direction from the extending part, and a hook part that fits into the engaged part of the flat cable, extending facing a direction opposite the direction in which the arm part extends.

Furthermore, in one embodiment of the connector, the housing may further have a first wall surface, and the elastic part and extending part may be disposed along the first wall surface of the housing.

Furthermore, in one embodiment of the connector, the housing may further have a second wall surface connected to the first wall surface and extending in a direction different from the first wall surface. The mounting part may be disposed along the second wall surface.

DETAILED DESCRIPTION OF THE PREFERRED EMBODIMENTS

Figure 1:
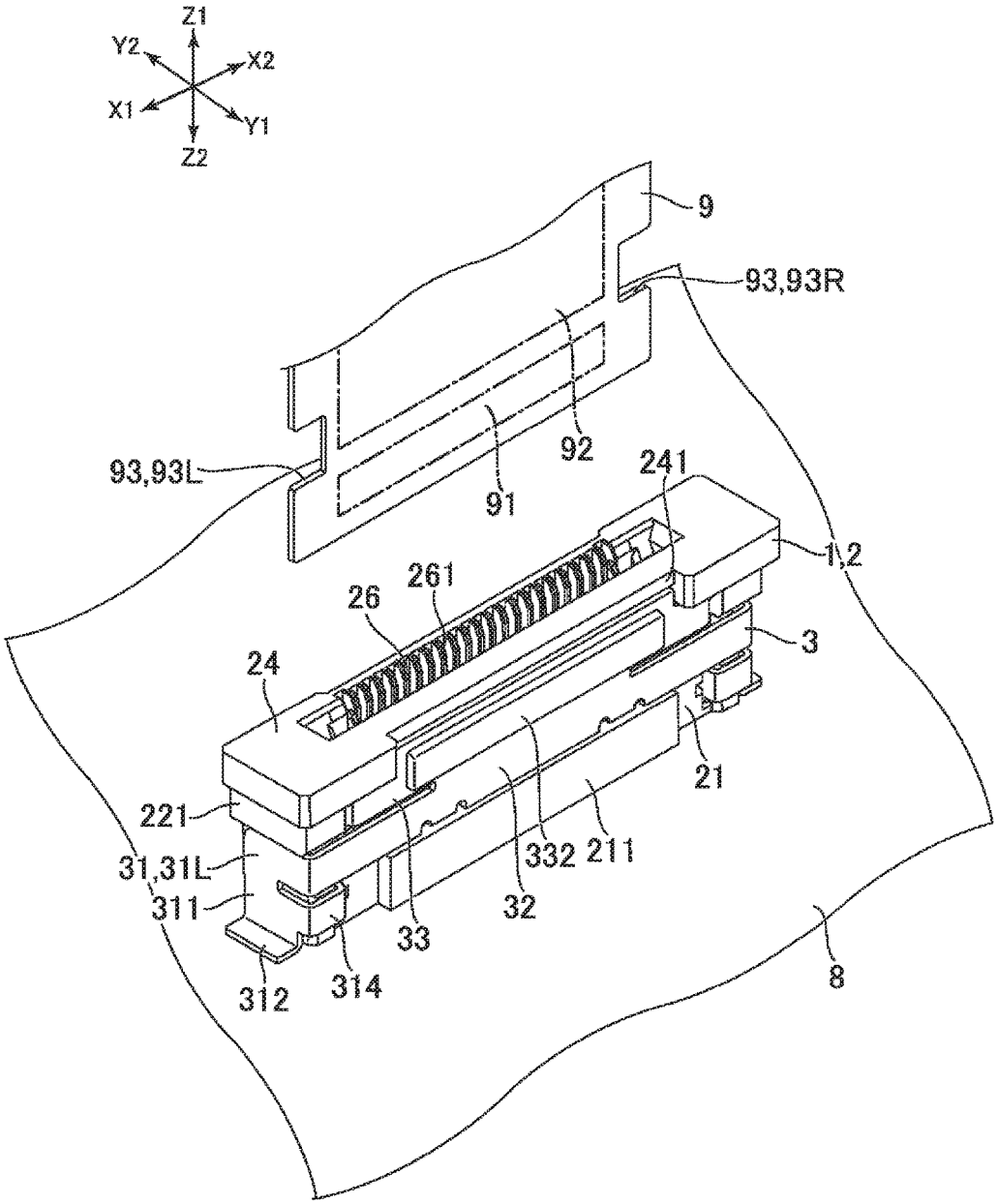
FIG. 1 is a perspective view illustrating the connector and the flat cable according to the present disclosure.
Figure 2:
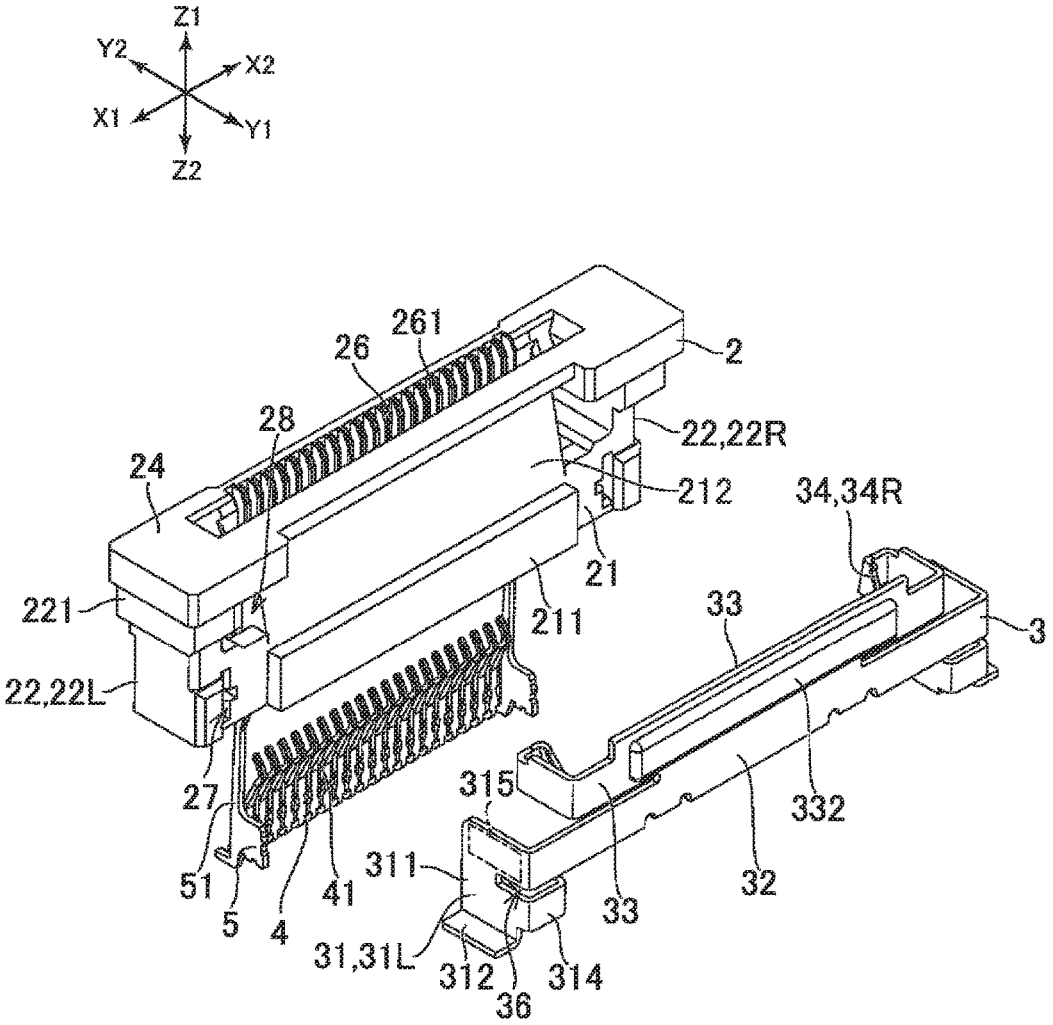
FIG. 2 is a perspective view illustrating the constituent components of the connector.
Figure 3:
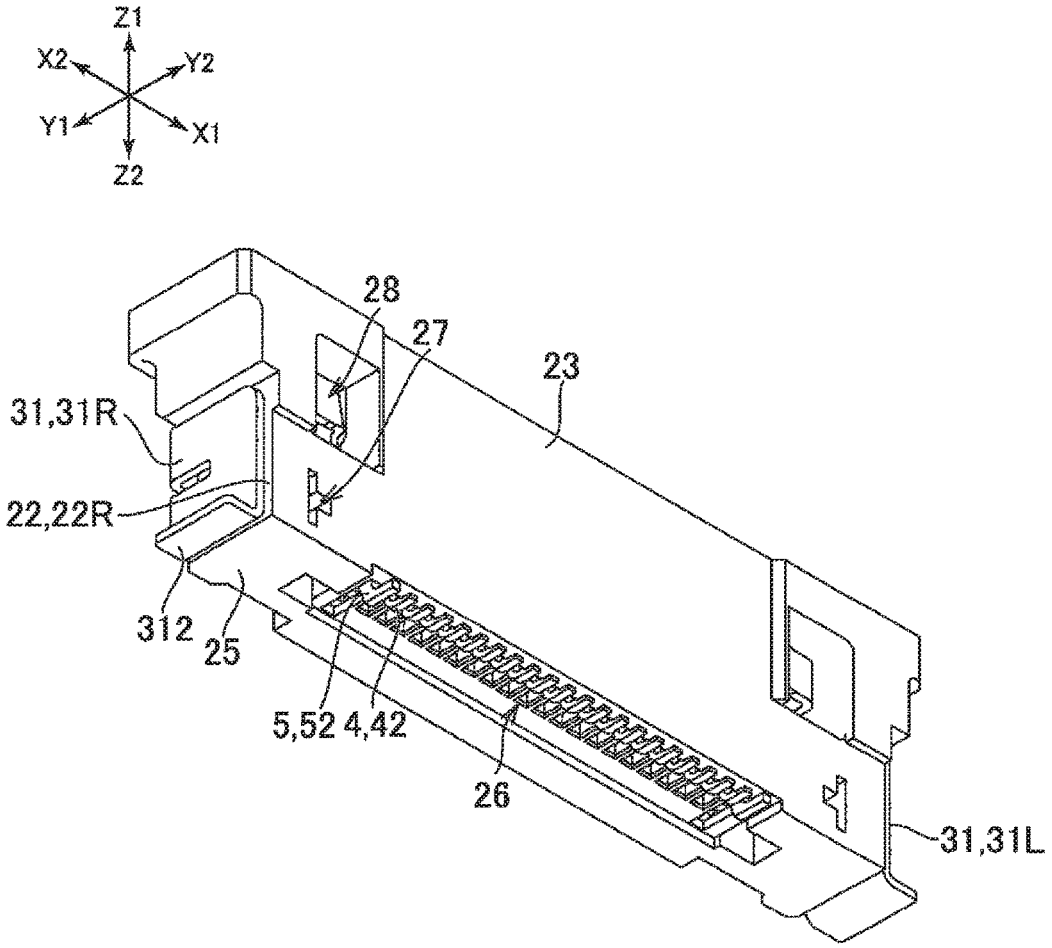
FIG. 3 is a perspective view illustrating the connector.
Figure 4:
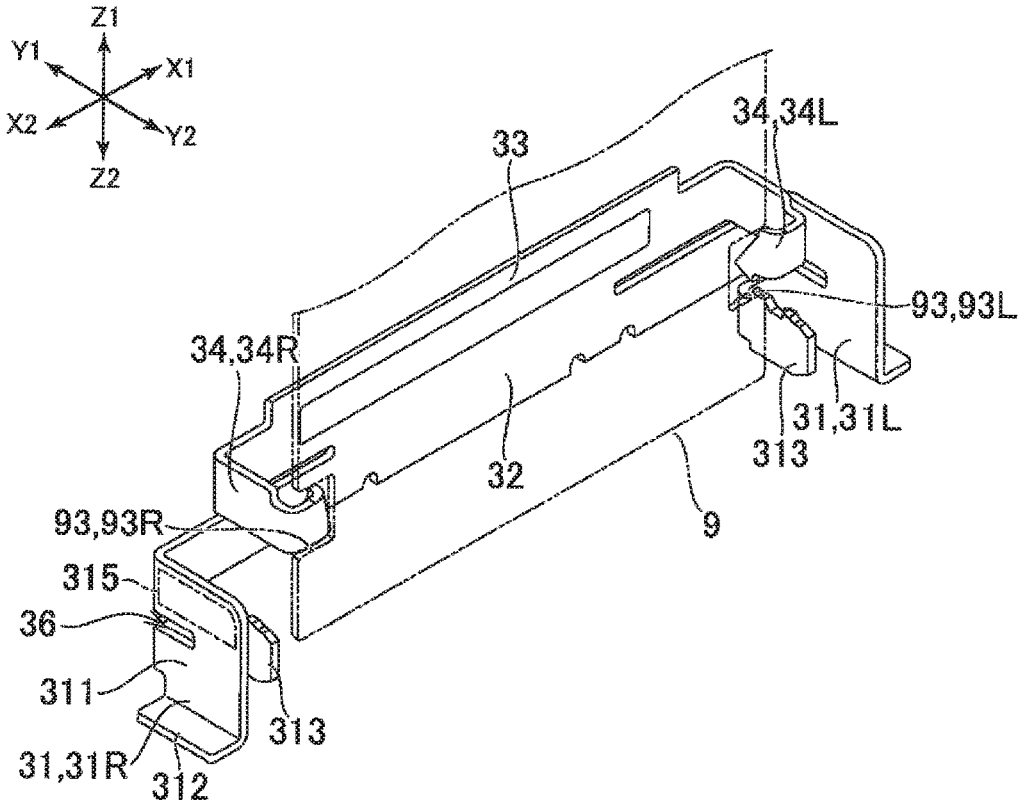
FIG. 4 is a perspective view illustrating the mounting member.
Figure 5:
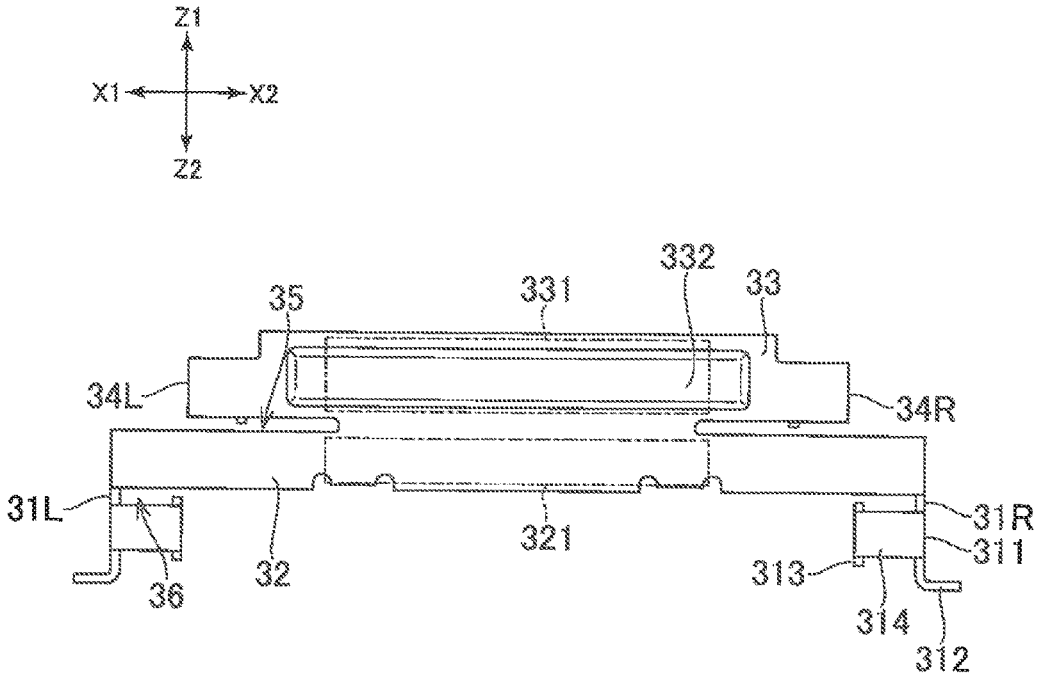
FIG. 5 is a front view illustrating the mounting member.
Figure 6:
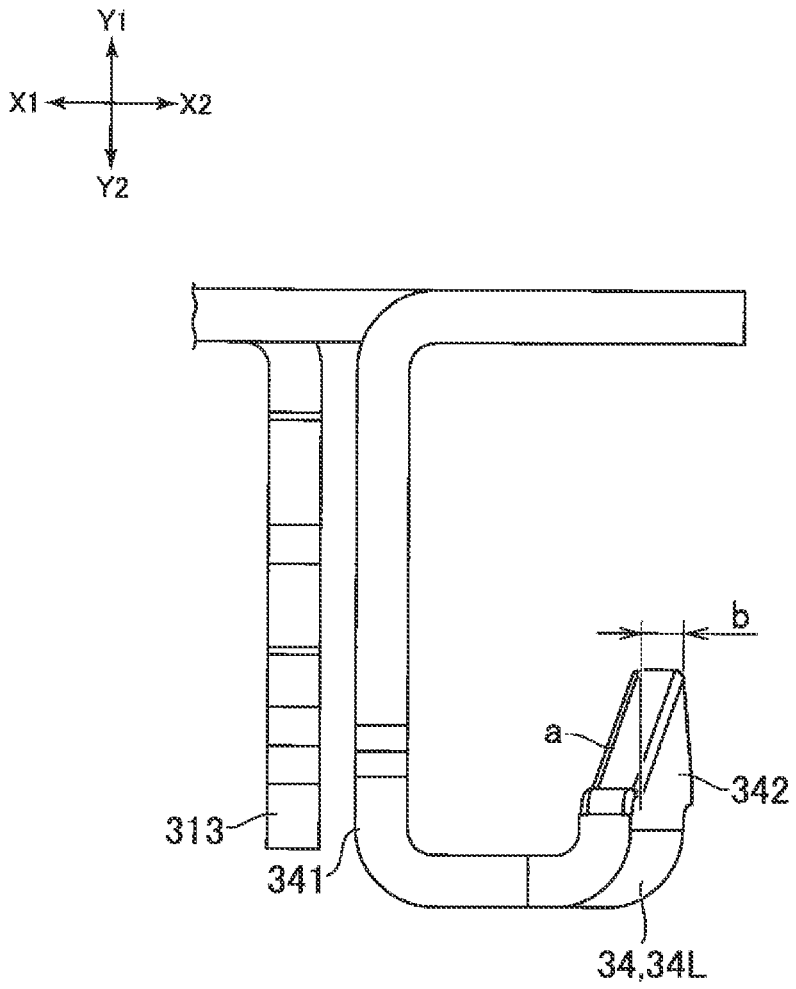
FIG. 6 is an upper surface view illustrating the engaging part formed on the mounting member.
Figure 7:
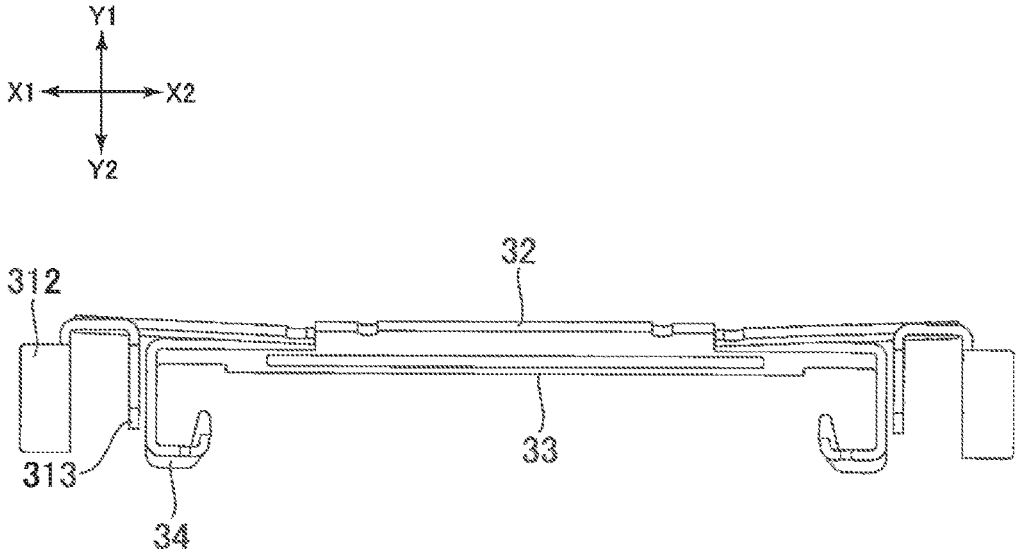
FIG. 7 is a lower surface view illustrating the mounting member when being operated by an operator.
Figure 8:
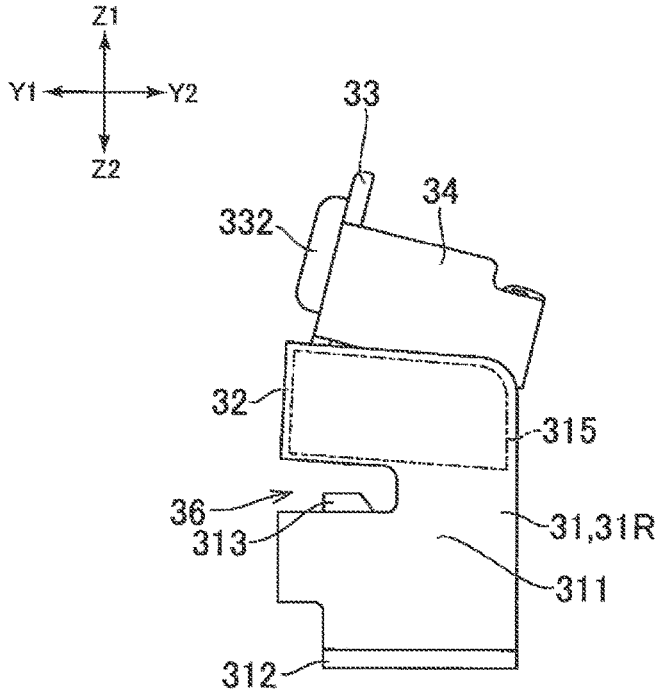
FIG. 8 is a side surface view illustrating the mounting member when being operated by an operator.

Below, embodiments of a connector 1 and a mounting member 3 according to the present disclosure will be described referring to FIG. 1 to FIG. 8. FIG. 1 is a perspective view illustrating the connector according to the present disclosure. FIG. 2 is a perspective view illustrating the constituent components of the connector. FIG. 3 is a perspective view illustrating the connector, and particularly illustrates the back surface and lower surface of the connector. FIG. 4 is a perspective view illustrating the mounting member and the flat cable, and particularly illustrates the back side of the mounting member. FIG. 5 is a front view illustrating the mounting member. FIG. 6 is an upper surface view illustrating the engaging part formed on the mounting member. FIG. 7 is a lower surface view illustrating the mounting member when being operated by an operator. FIG. 8 is a side surface view illustrating the mounting member when being operated by an operator.

In the present embodiment, the directions showing the width of a flat cable 9 inserted into a connector 1 (directions shown by X1 and X2 in each drawing) are respectively the left direction and right direction. Furthermore, the directions showing the thickness of the flat cable 9 inserted into the connector 1 (directions shown by Y1 and Y2 in each drawing) are respectively the front direction and back direction. Furthermore, the directions in which flat cable 9 is inserted into the connector 1 (directions shown by Z1 and Z2 in each drawing) are respectively the upward direction and downward direction. Note that the various directions are only used to describe the relative positional relationships of the parts that configure the connector 1, and thus do not illustrate absolute directions.

As illustrated in FIG. 1, the connector 1 according to the present embodiment is a connector in which the flat-type flat cable 9 can be inserted along the extending direction thereof (direction shown by Z1 and Z2 in FIG. 1), and the connector 1 may be used to electrically connect a member different from the flat cable 9. In the present embodiment, the connector 1 is formed in a substantially rectangular cylinder shape, and the flat cable 9 is inserted therein. For example, the flat cable 9 is a flexible printed circuit (FPC) or a flexible flat cable (FFC), but the flat cable 9 may be any kind of member, and for example, a printed circuit board may be used.

The flat cable 9 may be formed in a flat plate shape extending in the up-down direction, and at least one conductive pattern made up of a conductive material such as metal may be exposed on the surface thereof. In the present embodiment, the flat cable 9 has a plurality of first wiring patterns respectively contacted by a plurality of terminals 4 described hereinafter, and a second wiring pattern contacted by a second terminal 5. Here, the plurality of first wiring patterns is arranged in one line along the direction in which the plurality of terminals 4 is aligned (left-right direction in the present embodiment). Furthermore, the first wiring pattern is layered with respect to the second wiring pattern in an insulated state, the first wiring pattern is exposed on a first region 91 provided on the end part of the flat cable 9, and the second wiring pattern is exposed on a second region 92 provided above the first region 91. In the present embodiment, the first wiring patterns function as a control wire, power wire, signal wire, or the like, and the second wiring pattern functions as a ground wire, but the functions of the first and second wiring patterns are not necessarily limited to these.

Furthermore, as illustrated in FIG. 1 and FIG. 4, the flat cable 9 may have an engaged part 93 to which an engaging part 34 of the mounting member 3 described hereinafter engages. In the present embodiment, the engaged part 93 of the flat cable 9 is formed on the end part in the width direction of the flat cable 9. More specifically, a notch is formed on a left terminal and right terminal of the flat cable 9, a left side engaged part 93L is formed on the lower edge of the left side notch, and a right side engaged part 93R is formed on the lower edge of the right side notch. However, the engaged part 93 can have any shape as long as it can engage with the engaging part 34 of the mounting member 3. For example, the engaged part 93 may be formed on an edge of a through-hole or cavity formed along the thickness direction of the flat cable 9.

As illustrated in FIG. 3, the connector 1 according to the present embodiment has a housing 2, a mounting member 3, and at least one terminal 4. However, the components of the connector 1 are not necessarily limited to these. In the present embodiment, the housing 2 is formed in a substantially rectangular cylinder shape that has left-right symmetry, and has a plurality of wall surfaces. More specifically, as illustrated in FIG. 2 and FIG. 3, the housing 2 has a front surface 21, a left side surface 22L, a right side surface 22R, a back surface 23, an upper surface 24, and a lower surface 25. In the description below, the left-right side surfaces 22L and 22R of the housing 2 are also simply referred to as the side surfaces 22. However, the shape of the housing 2 is not necessarily limited to this.

Furthermore, as illustrated in FIG. 1, the connector 1 may be disposed on the circuit board 8, and may be electrically connected to a wiring pattern (not illustrated) provided on the surface of the circuit board 8. In the example illustrated in FIG. 1, the lower surface 25 (see FIG. 3) of the housing 2 is opposing the surface of the circuit board 8, but the position of the connector 1 with respect to the circuit board 8 is not limited to this. For example, the back surface 23 of the housing 2 may oppose the surface of the circuit board 8.

As illustrated in FIG. 1 and FIG. 3, a housing part 26 that houses the end part of the flat cable 9 may be formed on the inner side of the housing 2. The housing part 26 may include a space having a size in which at least the end part of the flat cable 9 can be housed. In the present embodiment, the housing part 26 pierces the housing 2 in the up-down direction, and includes a hole opened on the upper surface 24 and the lower surface 25 of the housing 2. However, the shape of the housing part 26 is not necessarily limited to this. For example, the housing part 26 may be configured including a groove provided extending on the surface of the front side and back side of the housing 2, having a width wider than the width of the flat cable 9.

The connector 1 has at least one terminal. As illustrated in FIG. 2 and FIG. 3, twenty terminals 4 are disposed aligned along the left-right direction on the housing part 26 of the housing 2 in the present embodiment. Specifically, a groove 261 in which the plurality of terminals 4 is disposed may be provided extending in the front-back direction on the back surface 23 side of the housing part 26 of the housing 2. Each of the plurality of terminals 4 forms an overall L-shape, is disposed in the groove 261, and has a contact point arm part 41 (see FIG. 2) extending in the front-back direction, and a terminal 42 (see FIG. 3) extending along the lower surface 25 of the housing 2. The plurality of terminals 4 and the circuit board 8 can be electrically connected by, for example, the end part 42 of the plurality of terminals 4 contacting a wiring pattern (not illustrated) provided on the surface of the circuit board 8. Furthermore, the plurality of terminals 4 and the flat cable 9 can be electrically connected by, for example, the contact point arm part 41 of the plurality of terminals 4 contacting a wiring pattern (not illustrated) of the flat cable 9. Note that the shape of each terminal 4 or the position where the plurality of terminals 4 is respectively disposed on the housing part 26 may be any shape or position. Furthermore, the number of terminals 4 housed in the housing part 26 may be one.

The connector 1 according to the present embodiment further has a second terminal 5 longer than the terminals 4, as a plurality of terminals. The second terminal 5 may be formed in an L-shape in the same manner as the terminal 4, and may have a contact point arm part 51 extending in the front-back direction and an end part 52 extending along the lower surface 25 of the housing 2. The second terminal 5 is disposed on the right side and left side of the plurality of terminals 4 aligned along the left-right direction, but the respective positions where the terminal 4 and the second terminal 5 are disposed are not limited thereto. The terminal 4 abuts the first wiring pattern exposed on the first region 91

(see FIG. 1) of the flat cable 9 in a state where the flat cable 9 is housed in the housing part 26, and the second terminal 5 abuts the second wiring pattern exposed on the second region 92 (see FIG. 1) of the flat cable 9. As described above, in the present embodiment, the first wiring pattern functions as a control wire, power wire, signal wire, or the like, and the second wiring pattern functions as a ground wire. Therefore, the terminal 4 contacting the first wiring pattern functions as a terminal for control, for power, or for a signal, and the second terminal 5 contacting the second wiring pattern functions as a ground terminal.

As illustrated in FIG. 1 and FIG. 2, the mounting member 3 may be mounted to the housing 2 to lock the flat cable 9 housed in the housing part 26 of the housing 2. In the present embodiment, the mounting member 3 is mounted to the front surface 21 of the housing 2. In the present embodiment, the mounting member 3 is formed by cutting a plate-shaped metal fragment and bending it. However, the shape, material, and formation method of the mounting member 3 is not limited thereto. For example, the material of the mounting member 3 may be any material as long as it is elastically deformable, such as resin, fiber-containing resin, or other such engineering plastic material, carbon fiber, or the like.

As illustrated in FIG. 1, FIG. 2, and FIG. 4, the mounting member 3 may have the mounting part 31, the elastic part 32, the extending part 33 and the engaging part 34. Here, the mounting part 31 may be fixed to at least one of the housing 2 and the circuit board 8. In the present embodiment, the mounting member 3 is formed having left-right symmetry, and has a left side mounting part 31L disposed along the left side surface 22L of the housing 2 and a right side mounting part 31R disposed along the right side surface 22R of the housing 2. Furthermore, the mounting member 3 may have the engaging part 34 that engages with the engaged part 93 of the flat cable 9. In the present embodiment, the mounting member 3 has the left side engaging part 34L that engages with the left side engaged part 93L and the right side engaging part 34R that engages with the right side engaged part 93R. Note that the mounting member 3 may be formed without having left-right symmetry. Furthermore, the number of mounting parts 31 and engaging parts 34 which the mounting member has is not limited to two, and may be one, or may be a plurality of three or more.

In the present embodiment, the mounting part 31 has a fixing part fixed to the housing 2 or the circuit board 8. More specifically, the left and right mounting parts 31L and 31R have a base part 311 disposed along the side surface 22 of the housing 2, a board fixing part 312 fixed to the circuit board by soldering or the like, and an inserting part 313 inserted into the housing 2 and fixed to the housing 2. Details of the board fixing part 312 and the inserting part 313 will be described later. Note that the mounting part 31 may be mounted to one of the housing 2 and the circuit board 8. For example, the mounting part 31 may be configured without one of the board fixing part 312 or the inserting part 313.

As illustrated in FIG. 5, the mounting member 3 may have an elastically deformable elastic part 32. The elastic part 32 may be formed in a plate shape, and may be disposed along the front surface 21 of the housing. In the present embodiment, the elastic part 32 extends along the width direction (left-right direction in the example illustrated in FIG. 5) of the flat cable 9 housed in the housing part 26 (see FIG. 1) of the housing 2. Also, the left-right mounting parts 31L, 31R connect to the end part in the width direction of the elastic part 32. However, the shape of the elastic part 32 is not necessarily limited to this. For example, the elastic part 32 may have a portion bowing or curving along the up-down direction or the front-back direction. As another example, the elastic part 32 may be divided at a position between the left-right mounting parts 31L, 31R.

Furthermore, the mounting member 3 may have an extending part 33 that extends along the front surface 21 of the housing 2. In the present embodiment, the extending part 33 is formed in a board shape similar to the elastic part 32, and extends along the width direction (left-right direction in the example illustrated in FIG. 5) of the flat cable 9 housed in the housing part 26 (see FIG. 1) of the housing 2. Also, the intermediate region 331 in the width direction of the extending part 33 connects to the intermediate region 321 in the width direction of the elastic part 32. Furthermore, the left-right engaging parts 34L, 34R connect to the end part in the width direction of the extending part 33. More specifically, the engaging part 34L of the left side connects to the left terminal of the extending part 33, and the engaging part 34R of the right side connects to the right terminal of the extending part 33. However, the shape of the elastic part 32 is not necessarily limited to this. The extending part 33 may also have a portion bowing or curving along the up-down direction or the front-back direction similar to the elastic part 32.

In such a manner, the elastic part 32 and the extending part 33 extend along the width direction (left-right direction in the present embodiment) of the flat cable 9, and the intermediate region 321 in the width direction of the elastic part 32 and the intermediate region 331 in the width direction of the extending part 33 are connected, and therefore, the spring length of the elastic part 32 can be sufficiently secured. Moreover, in the present embodiment, both the elastic part 32 and the extending part 33 are disposed along the front surface 21 of the housing 2. In so doing, when the mounting member 3 is pressed in from the front direction of the housing 2, hindering of the pressing in of the mounting member 3 by the elastic part 32 and the extending part 33 can be prevented.

Moreover, in the present embodiment, the extending part 33 is disposed on the upper side of the elastic part 32, and a first slit 35 is formed extending along the left-right direction between the elastic part 32 and the extending part 33. In the present embodiment, the first slit 35 is formed respectively on the right side and left side of the spot wherein the elastic part 32 and the extending part 33 are joined. However, the positional relationship of the elastic part 32 and the extending part 33 is not limited to this. For example, the extending part 33 may be formed below the elastic part 32. That is, if the engaging part 34 connected to the extending part 33 is elastically deformed and the release operation of the engagement of the engaged part 93 of the flat cable 9 is possible, then any shape and disposition is acceptable. As another example, one or both of the left terminal and the right terminal of the extending part 33 may be joined with the elastic part 32.

Moreover, an operating part 332 supplied to the operation of an operator may be formed on the extending part 33. In the present embodiment, the operating part 332 is formed using press processing, drawing processing, or the like. By forming the operating part 332 in such a manner, deformation, damage, or the like of the extending part 33 can be prevented and the strength can be improved, and by emphasizing the portion to be operated, it can be made easy for the operator to recognize visually, by touch, or the like. Note, the shape of the operating part 332 is not limited to this. For example, the operating part 332 may be a step provided on the extending part 33. The operating part 332 may be formed by bending the upper or lower end part of the extending part 33 into an L shape to the front or back from a profile perspective.

As illustrated in FIG. 6, the engaging part 34 may have an arm part 341 extending from the extending part 33 toward the back direction and a hook part 342 that fits into the engaged part 93 of the flat cable 9, extending in the front direction from the tip of the arm part 341. In the present embodiment, the arm part 341 is formed in an L shape. More specifically, the arm part 341 formed on the left side engaging part 34L has a portion extending from the left side to the right side and joined to the hook part 342, and the arm part 341 formed on the right side engaging part 34R has a portion extending from the right side to the left side and joined to the hook part 342. Furthermore, there may be a through hole 28 formed in the housing 2, which is a hole extending along the front-back direction through which the arm part 341 of the engaging part 34 passes. In the present embodiment, the through hole 28 is formed on the left side and the right side of the front surface 21 of the housing 2.

Furthermore, in the present embodiment, a sloped surface a extending in the tip direction and inclined downward is formed on the edge of the upper side of the hook part 342 of the engaging part 34. The sloped surface a is formed in this manner on the edge of the hook part 342, and as will be described hereafter, by the elastic part 32 elastically deforming and by the engaging part 34 moving in the back direction, the hook part 342 touching the front terminal of the flat cable 9 can pass over the surface of the flat cable 9 and move to a position (see FIG. 4) that engages with the engaged part 93 of the flat cable 9. Furthermore, in the present embodiment, the hook part 342 is formed in a substantially plate shape, and as illustrated in FIG. 6, extends aligned along the front-back direction tilted at an inclination relative to the up-down direction. Here, in the process of inserting the flat cable 9, the contact position b of the hook part 342 contacting the surface of the flat cable 9 is offset from the left to the right. Thus, wear on the flat cable 9 due to contact with the hook part 342 can be relieved. However, the shape of the engaging part 34 is not necessarily limited to this. For example, the shape of the engaging part 34 may be any shape as long as it can engage with the engaged part 93 of the flat cable 9.

As illustrated in FIG. 7 and FIG. 8, the elastic part 32 may be elastically deformable in the thickness direction (front-back direction in the present embodiment) of the flat cable 9. By the elastic part 32 elastically deforming in this manner, the extending part 33 and the engaging part 34 connected to the elastic part 32 can move in the front-back direction. For example, when an operator mounts the flat cable 9 to the connector 1, the tip of the flat cable 9 touches the hook part 342 of the engaging part 34, and by the hook part 342 moving to the back direction, the elastic part 32 is elastically deformed. As illustrated in FIG. 4, by the flat cable 9 moving to a position wherein the hook part 342 engages the engaged part 93 of the flat cable 9, the elastic part 32 returns from an elastically deformed state to the state prior to deformation. An operator can confirm that the flat cable 9 is inserted to the prescribed position from the sound and vibration at this time.

Furthermore, by the elastic part 32 elastically deforming to the back direction and the engaging part 34 moving to the back direction, the engaging part 34 may release the engagement of the flat cable 9 to the engaged part 93. As described above, in the present embodiment, an operating part 332 supplied to the operation of the operator is formed on the extending part 33. Thus, by a worker pressing the operating part 332 in the back direction, the elastic part 32 joined to the extending part 33 is elastically deformed in the back direction. The engaging part 34 joined with the extending part 33 also moves toward the back direction, and the engagement of the flat cable 9 to the engaged part 93 is released.

Furthermore, in the present embodiment, the left terminal and the right terminal of the elastic part 32 are joined to the left and right mounting parts 31L and 31R respectively, and the extending part 33 joined to the elastic part 32 is disposed above the left and right mounting parts 31L and 31R. Thus, as illustrated in FIG. 7, by the operator pressing the operating part 332, the elastic part 32 depresses to the back direction. As illustrated in FIG. 8, the elastic part 32 is elastically deformed into a twisted shape with respect to the rotational axis along the extending direction of the elastic part 32. In so doing, the extending part 33 connected to the elastic part 32 is tilted at a slope, and the engaging part 34 connected to the extending part 33 is moved toward a direction inclined downward and to the back. Thus, the engagement of the flat cable 9 to the engaged part 93 can be released.

As described above, by extending the elastic part 32 and the extending part 33 along the width direction of the flat cable 9 and connecting the intermediate region 321 in the width direction of the elastic part 32 and the intermediate region 331 in the width direction of the extending part 33, the spring length of the elastic part 32 can be sufficiently secured. Furthermore, by forming the operating part 332 on the extending part 33, the strength of the extending part 33 is improved, and deformation of the extending part 33 can be prevented even if the elastic part 32 deforms. Thus, the movement amount of the engaging part 34 that accompanies the deformation of the elastic part 32 can be sufficiently secured, and the engagement of the flat cable 9 to the engaged part 93 and the release of this engagement can be reliably carried out.

As described above, a board fixing part 312 fixed to the circuit board 8 and an inserting part 313 fixed to the housing 2 may be formed on the mounting part 31 of the mounting member 3. As illustrated in FIG. 2 and FIG. 3, in the present embodiment, the board fixing part 312 is formed on the lower terminal of the mounting part 31, and extends along the lower surface 25 of the housing 2. More specifically, the board fixing part 312 formed on the left side mounting part 31L extends from the base part 311 to the left side, and the board fixing part 312 formed on the right side mounting part 31R extends from the base part 311 to the right side. However, the disposed position and extending direction of the board fixing part 312 is not necessarily limited to this.

The inserting part 313 may extend from a connecting part 314 described hereafter toward the back direction, and may be inserted in the housing 2. As illustrated in FIG. 2 and FIG. 3, a press fitting part 27 press fitted by the mounting member 3 may be formed on the housing 2, and the mounting member 3 may be fixed to the housing 2 by the inserting part 313 being inserted into this press fitting part 27. As illustrated in FIG. 4, a plurality of irregularities may be formed on the edge of the inserting part 313. In so doing, the inserting part 313 can catch on the inner side of the press fitting part 27, and the fixing of the mounting member 3 to the housing 2 can be strengthened. However, the shape of the inserting part 313 is not necessarily limited to this. Note that in the present embodiment, the press fitting part 27 is a hole piercing the housing 2 along the front-back direction, but the press fitting part 27 may be concave or it may be a notch. In the present embodiment, the press fitting part 27 has a long opening in the up-down direction when viewed from the front, but the shape of the hole of the press fitting part 27 is not necessarily limited to this.

Furthermore, as illustrated in FIG. 5, the base part 311 of the mounting part 31 and the inserting part 313 may be joined via the connecting part 314 extending along the left-right direction. In the present embodiment, as illustrated in FIG. 4, the inserting part 313 is disposed in a position separated downward from the elastic part 32. Furthermore, in the present embodiment, as illustrated in FIG. 5, the connecting part 314 is also disposed in a position separated downward from the elastic part 32. Here, a second slit 36 is formed between the connecting part 314 and the elastic part 32. Further, as illustrated in FIG. 2, FIG. 4, and FIG. 8, the second slit 36 also reaches the mounting part 31 disposed along the side surface 22 of the housing 2.

Furthermore, as illustrated in FIG. 8, the mounting part 31 may have an elastic region 315, which is an elastically deformable region. In the present embodiment, the elastic region 315 is disposed along the side surface 22 of the housing 2. Furthermore, the elastic region 315 is disposed at a position separated from the board fixing part 312 fixed to the circuit board 8 and from the inserting part 313 fixed to the housing 2. For example, the elastic region 315 may be disposed on the second slit 36. The mounting part 31 is connected to the end part in the width direction of the elastic part 32 on the elastic region 315. By the elastic region 315 of the mounting part 31 elastically deforming along with the deformation of the elastic part 32, the deformation amount of the elastic part 32 can be made even greater. Thus, the engagement of the flat cable 9 to the engaged part 93 and the release of this engagement can be reliably carried out.

Further, in the present embodiment, the inserting part 313 is not joined to the elastic part 32 on at least the front surface 21 of the housing 2. Thus, loosening of the fixing to the housing 2 caused by elastic deformation of the elastic part 32 can be prevented. However, the shape of the connecting part 314 and the disposed position of the connecting part 314 in relation to the elastic part 32 are not necessarily limited to this. For example, the connecting part 314 may be disposed above the elastic part 32.

As illustrated in FIG. 2, a convex part 211 may be formed on the front surface 21 of the housing 21 protruding in the front direction from the front surface 21 thereof. As illustrated in FIG. 1, when the mounting member 3 is mounted to the housing 2, the convex part 211 may support the mounting member 3 from below.

Furthermore, as illustrated in FIG. 2, a sloped surface 212 inclined at a slope in the up direction and the back direction may be formed above the convex part 211 of the housing 2. When the operating part 332 of the mounting member 3 is pressed by an operator (see FIG. 7 and FIG. 8), the extending part 33 of the mounting member 3 may abut the sloped surface 212 of the housing 2. In so doing, excessive deformation of the mounting member 3 can be prevented, and plastic deformation and damage of the mounting member 3 can be prevented.

Furthermore, as illustrated in FIG. 1 and FIG. 2, the edge part 241 of the front side of the upper surface 24 of the housing 2 may protrude in the front direction more than the front surface 21 of the housing 2. The edge part 241 may cover the gap between the extending part 33 formed by the operating part 332 and the sloped surface 212 formed on the housing 2. In so doing, operation errors wherein the operator inserts a finger or the like in the gap between the operating part 332 and the sloped surface, and the operating part 332 is pulled forward can be prevented. Furthermore, the stepped part 221 may be formed protruding in the external direction of the housing 2 on the upper side of the front surface 21 and the side surface 22 of the housing 2. Slipping out of the mounting member 3 can be prevented by the stepped part 221 covering the gap between the end part and the mounting part 31 of the elastic part 32 and the housing 2.

Note that the present disclosure according to the present specification is only one example, and thus any appropriate change that preserves the gist of the present disclosure and can easily be conceived by a person skilled in the art is within the scope of the present disclosure. Furthermore, the width, thickness, shape, and the like of each part illustrated in the drawings are schematically expressed, and are not limited to the interpretation of the present disclosure.

The invention claimed is:

1. A connector comprising:

a housing having a housing part housing a flat cable;

a plurality of terminals disposed in the housing part aligned along a width direction of the flat cable housed in the housing part; and a mounting member mounted to the housing for locking the flat cable, wherein the mounting member has:

a mounting part mounted to at least one of the housing and a circuit board, an elastic part extending in the width direction of the flat cable, an extending part extending in the width direction of the flat cable, and an engaging part engaging with an engaged part formed on the flat cable, and the mounting member is connected to an end part in a width direction of the elastic part, an intermediate region of the extending part is connected to an intermediate region in the width direction of the elastic part, the engaging part is connected to a terminal part in a width direction of the extending part, and the elastic part is elastically deformable in a thickness direction of the flat cable.

2. The connector according to claim 1, wherein the mounting member has a first mounting part positioned at one end part of the elastic part, and a second mounting part positioned at another end part of the elastic part.

3. The connector according to claim 1, wherein the engaging part has an arm part extending toward the thickness direction from the extending part, and a hook part that fits into the engaged part of the flat cable, extending toward a direction opposite a direction in which the arm part extends.

4. The connector according to claim 1, wherein the housing further comprises a first wall surface, and the elastic part and the extending part are disposed along the first wall surface of the housing.

5. The connector according to claim 4, wherein the housing further comprises a second wall surface connected to the first wall surface and extending in a direction different from the first wall surface, and the mounting part is disposed along the second wall surface.

6. The connector according to claim 1, wherein the mounting part has a fixing part fixed to the housing or the circuit board, and an elastically deformable elastic region positioned separated from the fixing part, and the mounting member is connected to an end part in the width direction of the elastic part in the elastic region.

7. The connector according to claim 6, wherein the fixing part has an inserting part inserted into the housing that fixes the fixing part to the housing.

8. The connector according to claim 6, wherein the fixing part has a board fixing part fixed to the circuit board.

* * * * *